US006438209B1

(12) United States Patent
Rössiger

(10) Patent No.: US 6,438,209 B1
(45) Date of Patent: Aug. 20, 2002

(54) APPARATUS FOR GUIDING X-RAYS

(75) Inventor: Volker Rössiger, Sindelfingen (DE)

(73) Assignee: Helmut Fischer GmbH & Co. Institut fur Elektronik und Messtechnik (DE)

( * ) Notice: Subject to any disclaimer, the term of this patent is extended or adjusted under 35 U.S.C. 154(b) by 0 days.

(21) Appl. No.: 09/707,394

(22) Filed: Nov. 6, 2000

(30) Foreign Application Priority Data

Nov. 12, 1999 (DE) ..... 199 54 520

(51) Int. Cl.[7] ..... G21K 1/04
(52) U.S. Cl. ..... 378/150; 378/84

(58) Field of Search ..... 378/44, 45, 145, 378/147, 148, 149, 70, 84, 150

(56) References Cited

U.S. PATENT DOCUMENTS 4,958,363 A * 9/1990 Nelson et al. ..... 378/85
5,001,737 A * 3/1991 Lewis et al. ..... 378/147
5,016,267 A * 5/1991 Wilkins ..... 378/84

* cited by examiner

*Primary Examiner*—Robert H. Kim
*Assistant Examiner*—Jurie Yun

(57) ABSTRACT

Apparatus for guiding X-rays from a radiation source to a measurement object (16) having at least two reflecting areas (18) forming a slit.

15 Claims, 3 Drawing Sheets

APPARATUS FOR GUIDING X-RAYS

Figure 1:
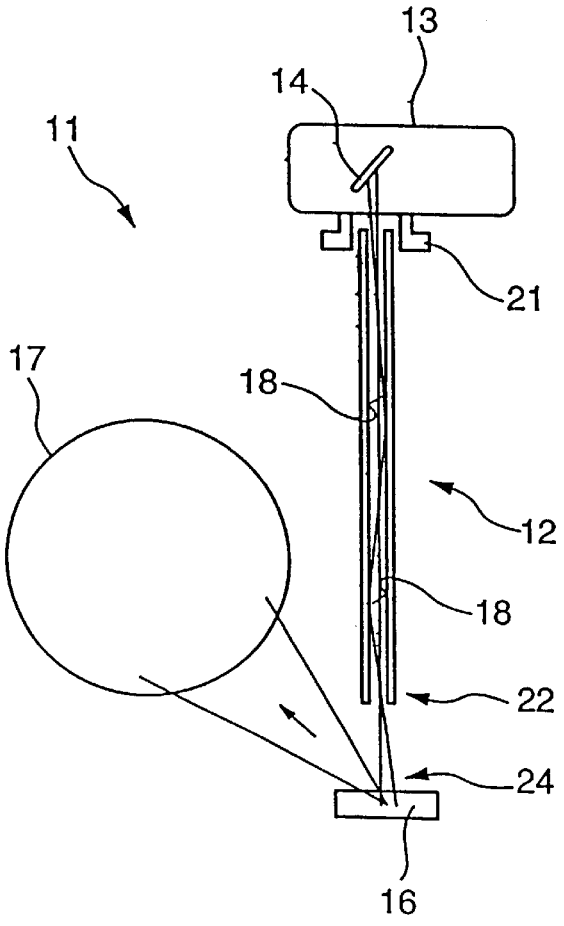

The invention relates to an apparatus for guiding X-rays from a radiation source to a measurement object.

The X-ray fluorescence method is used for measuring thin layers or multilayers. In the course of layer analysis of this type, the X-ray fluorescent radiation of the individual elements of a sample is detected and converted into layer thickness(es) and composition(s). Masked by a collimator system, the exciting X-rays pass in the form of a fine beam of rays to the measurement area. From here, the X-ray fluorescent radiation is emitted. The radiation is detected in an energy-dispersive manner in a proportional counter tube or another detector. Functional areas having dimensions up to a size of 100 $\mu$m×100 $\mu$m, for example, can be determined exactly in a contactless and non-destructive manner by means of a layer thickness analysis of this type.

For the layer thickness analysis of smaller functional areas of less than 100 $\mu$m×100 $\mu$m, for example, X-ray conductors are known which enable the X-rays to be focussed onto these small functional areas. They are what are called monocapillaries. These monocapillaries are designed cylindrically in the form of a small glass tube. Total reflection at the walls of the glass tube enables the X-rays to be guided with sufficient intensity to the measurement object.

Furthermore, the collimators designed as monocapillaries have been developed further to the effect that the internal walls of the glass tubes are of parabolic design, so that the reflected rays are intended to be focussed towards the measurement object. Moreover, so-called polycapillaries are known. These are a monolith which has a bundle of a plurality of monocapillaries, the latter in turn being arranged in such a way that the X-rays which are guided in a targeted manner are focussed at a point outside the exit plane of the monolith.

These capillaries have the disadvantage that they are expensive and layer-thickness measuring devices with these collimators cannot be produced economically. Moreover, the above-described collimators have the disadvantage that their diameter is fixed, so that there is no possibility for adjusting and focussing the X-rays to a different size of the measurement object. Furthermore, these collimators have the disadvantage that procurement is made extremely difficult since the production of these collimators is monopolized in particular on account of their complexity.

The invention is based on the object, therefore, of providing an apparatus for guiding the X-rays from a radiation source to a measurement object, in particular for small structure sizes having a functional area of less than 100 $\mu$m×100 $\mu$m, which can be produced cost-effectively, can be adjusted to the measurement area to be measured, and enables sufficient transmission of the radiation intensity to the measurement object.

This object is achieved according to the invention by means of an apparatus in accordance with claim 1.

The invention's configuration of at least two reflecting areas forming a slit has the advantage that a simple arrangement has been created which enables the X-rays to be guided with sufficient intensity to the measurement object, in order to enable the detector to detect a sufficient intensity of the fluorescent radiation emitted. The at least two reflecting areas forming a slit are simple to produce. In comparison with the mono- and/or polycapillaries known from the prior art, manufacturing methods for producing the apparatus for guiding X-rays are not complicated.

In contrast to the prior art, in which the mono- or polycapillaries are formed from completely closed small glass tubes, it suffices according to the subject-matter of the invention for the X-rays to be guided to the measurement object by total reflection within a slit formed by at least two reflecting areas. The X-rays emerging laterally from the slit or slits are ineffective for the excitation of the fluorescent radiation, but an at least sufficient intensity is conveyed or transferred to the measurement object by the total reflection of the X-rays between the at least two reflecting areas forming a slit.

One advantageous embodiment of the invention provides for the slit formed by the at least two reflecting areas to have an adjustable width. This enables the size of the measurement area on the measurement object to be adjustable. Consequently, the apparatus can be adjusted and adapted to different requirements of the layer thickness analysis.

One advantageous embodiment of the invention provides for two reflecting areas to be provided which are opposite one another and are arranged parallel to one another. This can provide a structurally simple configuration for guiding X-rays. The slit width is adapted at least to the size of the measurement area of the measurement objects and advantageously to the exit opening of the X-ray tube, so that a maximum radiation intensity can be transferred to the measurement object.

An alternative embodiment of the invention provides for two reflecting areas to be provided which are opposite one another and have a slit which tapers towards the measurement object. Additional focussing of the X-rays can be obtained by virtue of this approximately wedge-shaped arrangement of the reflecting areas. The aperture width of the reflecting areas between the input and the output provided at the tapering end may be in the micrometer range or larger;

A further advantageous embodiment of the invention provides for at least one reflecting area to be fixed and at least one further reflecting area to be adjustable in terms of distance and/or angle. This means that optionally either distance and/or angle can be adjusted in a manner dependent on the application, one reflecting area serving as a reference area.

A further advantageous embodiment of the invention provides for the reflecting areas to be produced from a semiconductor material, in particular from a silicon wafer. Industrial production of the silicon wafers has become cost-effective in the mean time. Moreover, on account of the highly planar configuration, the silicon wafers have a surface which is suitable for the total reflection of the X-rays. The critical angle of total reflection is a few mrad, for example, depending on the energy of the X-rays. The rays can be forwarded in a manner sufficiently free of losses by virtue of the high-quality planar surface of the silicon wafers.

It is advantageously provided that the reflecting areas at least partly have vapour-deposited on them a noble metal, preferably copper, silver, gold, platinum, palladium or the like. By virtue of this coating, which is preferably provided on a silicon wafer, the critical angle can be increased to 4.5 mrad, for example in the case of a platinum coating, as a result of which the critical angle for total reflection can be increased. This in turn leads to the effect whereby there is a higher intensity of the X-rays at the measurement object, which means that it is possible to provide a sufficiently high intensity for emitting fluorescent rays.

A further advantageous embodiment of the invention provides for the coating to be provided at least partly at an end facing the beam exit of the X-ray tube. This enables a multiplicity of X-rays to be reflected by total reflection in the input region, as a result of which a high intensity can be obtained.

A further advantageous embodiment of the invention provides for the reflecting areas to have near the measurement object a region which has a coating that prevents total reflection, or, in the case of at least partly coated reflecting areas, has a region which is provided without a coating or in which a coating that prevents total reflection is provided.

This means that it becomes possible to eliminate the total reflection of rays which would lie outside the measurement region after a final reflection prior to exit from the reflecting areas. This arrangement makes it possible to obtain even more exact irradiation of the measurement area at a measurement object, which in turn increases the measurement quality.

One advantageous embodiment of the invention provides for at least one reflecting area to be adjustable by at least one adjusting unit. This adjusting unit may advantageously be designed as precision mechanical adjustment or as an electrical, hydraulic, pneumatic or piezo-electronic actuator. This adjusting unit must enable adjustments at least in the micrometer range in order to afford exact orientation and adjustment of the at least two reflecting areas which are arranged relative to one another.

Further advantageous embodiments and developments of the invention are specified in the rest of the claims.

Figure 2:
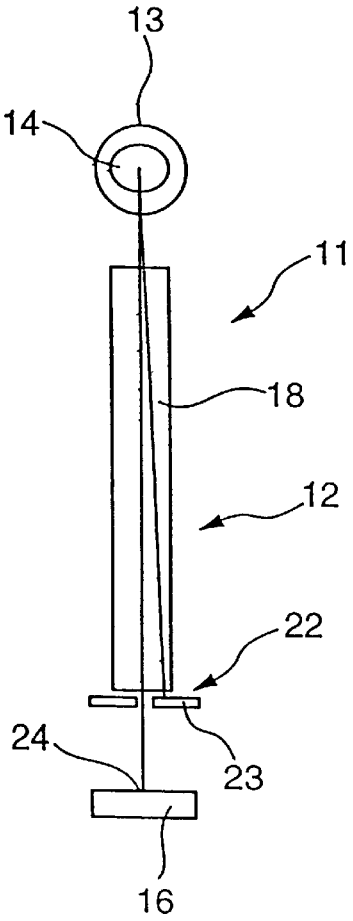
Figure 3:
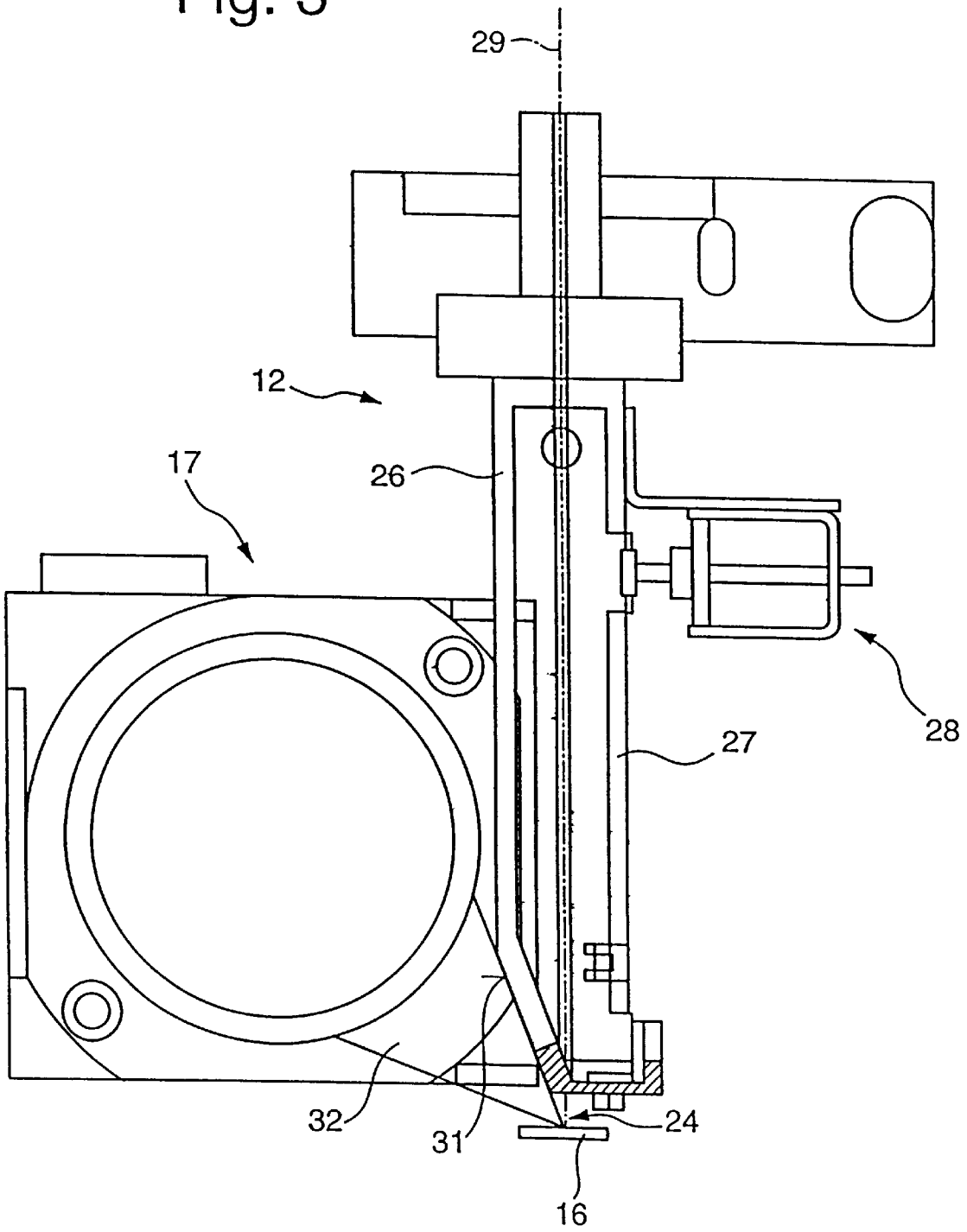
Figure 4:
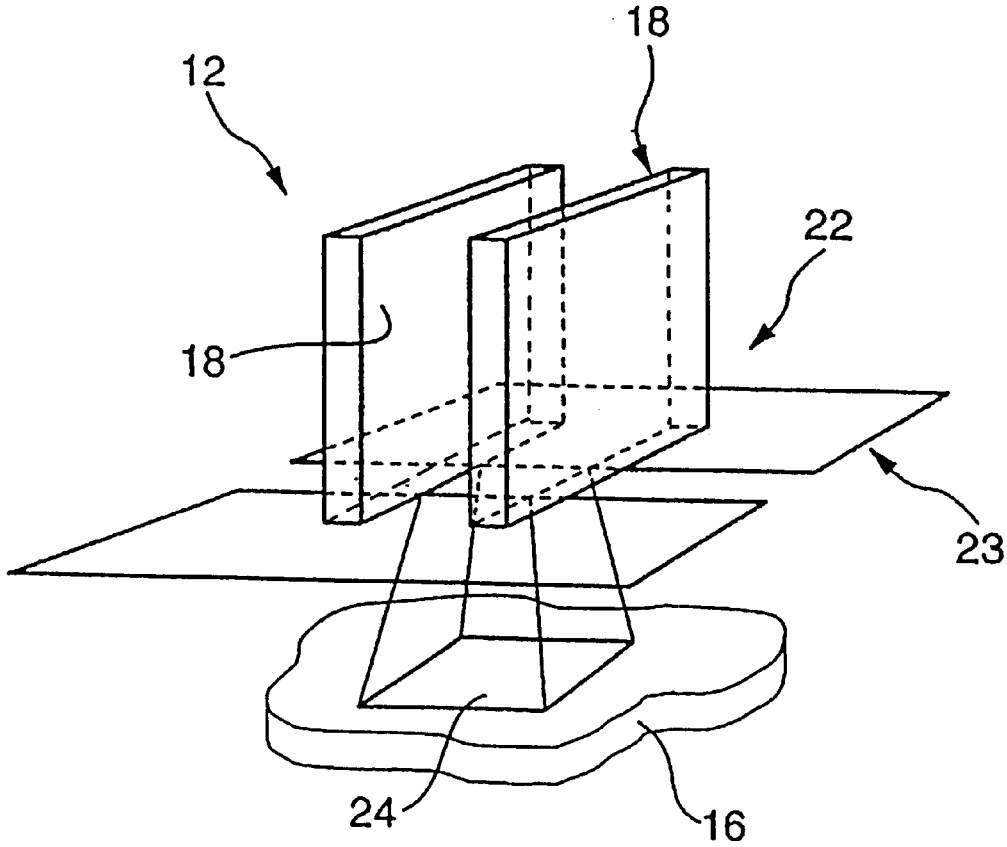

A preferred embodiment is described in more detail with reference to the drawings and descriptions below. In the figures:

FIG. 1 shows a schematic view of a layer-thickness measuring device with an apparatus according to the invention, FIG. 2 shows a schematic side view of the layer-thickness measuring device illustrated in FIG. 1, FIG. 3 shows a schematic detail illustration of the apparatus according to the invention, and FIG. 4 shows a schematically enlarged illustration of an end of the apparatus according to the invention which points towards the measurement object.

FIG. 1 schematically illustrates the essential components of a layer-thickness measuring device 11, in which case the illustration of an evaluation unit, a screen for visualizing a measurement object recorded by a video camera, and also an input keyboard and printer has been dispensed with. This layer-thickness measuring device 11 is used for example for measuring bonding pads, contacts which are provided in part with a selective coating, conductor tracks and functional coatings on small areas. A layer-thickness measuring device 11 with the apparatus 12 according to the invention is preferably used to determine or check layer thicknesses whose measurement area or the functional areas are smaller than 100 $\mu$m×100 $\mu$m, in particular smaller than 50 $\mu$m×50 $\mu$m. X-rays are generated in an X-ray tube 13 and are directed via an anode 14 to a measurement object 16. The X-rays excite a fluorescent radiation in a layer of the measurement object 16. The intensity of this fluorescent radiation depending on the energy (spectrum) is a function of the layer thickness. This or the parameter of the layer system is utilized by the system of the emitted radiation being registered with the aid of a detector 17.

The apparatus 12 according to the invention is provided between the X-ray tube 13 and the measurement object 16, which apparatus, in accordance with the exemplary embodiment, comprises two mutually opposite reflecting areas 18. These reflecting areas 18 serve for focussing rays and forwarding rays, with the result that the X-rays pass to the measurement area of the measurement object 16. The reflecting areas 18 are preferably arranged directly relative to the anode 14 or to an exit flange 21 near the anode 14. Furthermore, a collimator 23 is provided at the lower end 22 of the reflecting areas 18 which are assigned to one another, as a result of which it is possible to image a measurement region 24 as shown in FIG. 3 on a measurement object. The collimator 23 is advantageously a slit collimator whose slit width is adjustable.

The reflecting areas 18 are designed as elongate, rectangular areas, as can be gathered from FIG. 1 and FIG. 2. The length of the reflecting areas 18 is essentially determined by the construction and also by the degree of total reflection. X-rays which do not run parallel between an axis of the measurement region 24 and the anode 14 are deflected at least once by total reflection. The width of the reflecting areas 18 is at least one and a half times as large as the maximum functional area to be checked. It is advantageous to use silicon wafers for the reflecting areas 18. This cost-effective base material can be adapted in a simple manner to the corresponding size of the apparatus 12 according to the invention. Further semiconductor materials such as, for example, germanium, gallium arsenide or the like are also suitable for the reflecting areas 18.

The reflecting areas 18, which are preferably produced from a silicon wafer, are advantageously applied to holding elements 26, 27 as shown in FIG. 3. These are advantageously bonded on in a strain-free manner, so that the planarity of the reflecting area 18 can be maintained. As an alternative, the reflecting areas 18 can also be fixed in a stress-free manner on the holding elements 26, 27 by means of clamping or the like. As shown in FIG. 3, an adjusting unit 28 engages on one of the two holding elements 27, by means of which adjusting unit a holding element 27 can be adjusted relative to the stationary element 26. The holding element 26 advantageously accommodates the reflecting area 18 parallel to the central axis 29 of the apparatus 12. The slit width can be adjusted by the adjusting unit 28. It likewise becomes possible to adjust the angularity of the holding element 27 relative to the element 26. As an alternative, it is likewise possible to provide a mirror-inverted arrangement. Likewise, provision may alternatively be made for an adjusting unit 28 to be provided on each of the holding elements 26, 27, as a result of which the holding elements 26, 27 can be arranged either parallel to one another and/or at an angle to one another, thereby forming a uniform or tapering slit towards the measurement object 16. The adjusting unit 28 is designed in such a way that slit widths in a range of from 10 to 100 $\mu$m, for example, can optionally be adjusted. For this purpose, it is possible to provide precision-mechanical adjusting mechanisms, piezo-electric actuators, and also electrically, hydraulically, pneumatically operated actuating drives.

At an end pointing towards the measurement object 16, a flattened portion 31 is provided on the holding element 26. This flattened portion makes it possible for there to be a sufficient aperture width 32 available for the emitted fluorescent radiation in order to detect the emitted fluorescent radiation.

The reflecting area 18 may, for example, have a noble metal vapour-deposited on it. This makes it possible to increase the critical angle for total reflection, which is 1.5 mrad for silicon, to 4.5 mrad by means of a platinum coating. This in turn has an advantageous effect on the transmission of the X-rays. As an alternative, in the case where coated reflecting areas are used, it is conceivable that the base material may comprise a quartz surface or a plastics material which satisfies the requirement of planarity and has a coating. The coating may advantageously be provided at least at the input of the reflecting areas 18, so that the number of captured and reflected rays is as large as possible. The coating may be continued completely over the course along the reflecting areas 18, or else be provided only partly. Likewise, the coating or the material of the coating may also change depending on the applications. By way of example, by reducing the critical angle for total reflection, it is possible to reduce the divergence at the output of the reflecting areas 18, which makes it possible to obtain focussing of the radiation and, as a result, an intensity increase on the measurement region 24 of the measurement object 16. To that end, it is conceivable, for example, for a coating not to be provided in a region near the lower end 22 of the reflecting area 18 or for a coating that prevents total reflection to be provided, as a result of which the radiation emerging below the reflecting area 18 is focussed precisely to the size of the measurement region 24 of the measurement object 16. The irradiation of edge regions outside the measurement region 24 can thereby be reduced considerably.

The invention's configuration of the apparatus 12 enables the measurement region to be adjusted depending on the measurement task. The collimator 23 can likewise be adapted to this measurement region, so that the focussing of the radiation enables an intensity increase on a predetermined measurement region.

As an alternative, it may be provided that the reflecting areas 18 are designed to be at least slightly concave. Likewise, the concave design may taper towards the lower end 22, yielding a kind of meslithone-shaped configuration of the reflecting areas 18. In this case, however, account should be taken of the dimensions, which can also lie in the micrometer range.

The aperture width of the reflecting areas 18 at the input of the apparatus 12 essentially corresponds to the outlet opening for the X-rays emitted via the anode. Likewise, it is also possible to provide a slightly larger or smaller aperture width relative to the diameter of the primary spot of the X-rays.

Furthermore, the apparatus 12 may also have openings and receptacles which serve for arranging an optical system in order to visualize the measurement object 16 using a video camera.

In accordance with the exemplary embodiment, the apparatus 12 is provided by two reflecting areas 18 which are arranged relative to one another and are arranged parallel or at an acute angle relative to one another. It may also be provided that, instead of these two reflecting areas 18, three or more reflecting areas are arranged in a suitable manner relative to one another in order to enable the transmission of X-rays to the measurement region 24 of a measurement object 16, so that an intensity increase is made possible by the focussing of the X-rays. However, in contrast to what is known from the prior art, it is not necessary to use a closed, tubular arrangement in order to focus the X-rays to the measurement region by total reflection. Further geometrical configurations of the reflecting areas 18 which enable the total reflection of the X-rays are likewise conceivable.

What is claimed is:

1. An apparatus for guiding x-rays from a radiation source to a measurement object, comprising at least two reflecting areas forming a slit, the reflecting areas being of planar design, the at least two reflecting areas being opposite one another and providing a slit that tapers towards the measurement object, and a collimator assigned to the at least two reflecting areas at an end of the at least two reflecting areas pointing towards the measurement object.

2. The apparatus according to claim 1, wherein the collimator comprises a slit width that is adjustable.

3. The apparatus according to claim 1, wherein the slit formed by the at least two reflecting areas has an adjustable width.

4. The apparatus according to claim 1, wherein at least one of the at least two reflecting areas is fixed and at least one of the at least two reflecting areas is adjustable in at least one of distance and angle.

5. The apparatus according to claim 1, wherein at least one of the at least two reflecting areas is arranged substantially directly at an exit flange of the x-ray tube.

6. The apparatus according to claim 1, wherein at least one of the at least two reflecting areas comprises a concavely curved design, as seen in cross section.

7. The apparatus according to claim 1, wherein the at least two reflecting areas comprise semiconductor material.

8. The apparatus according to claim 7, wherein the semiconductor material comprises a silicon wafer.

9. The apparatus according to claim 1, wherein at least one of the at least two reflecting areas is at least partly coated with a noble metal.

10. The apparatus according to claim 9, wherein the noble metal is selected from gold, platinum, copper, silver, and palladium.

11. The apparatus according to claim 9, wherein the partly coated reflecting area is provided at an end facing towards the beam exit of the radiation source.

12. The apparatus according to claim 9, wherein the partly coated reflecting area comprises a region without a coating near the measurement object.

13. The apparatus according to claim 9, wherein the partly coated reflecting area comprises a coating that prevents total reflection.

14. The apparatus according to claim 1, wherein at least one of the at least two reflecting areas comprises an uncoated reflecting area near the measurement object.

15. The apparatus according to claim 1, wherein at least one of the at least two reflecting areas comprises an adjusting unit that adjusts the aperture width of the slit.

* * * * *